US012758031B2

(12) United States Patent
Zhou et al.

(10) Patent No.: US 12,758,031 B2
(45) Date of Patent: Oct. 13, 2026

(54) SMART FURNITURE CONTROLLER

(71) Applicant: eMoMo Technology Co., Ltd., Shenzhen (CN)

(72) Inventors: Wei Zhou, Wuhan City (CN); Wenji Tang, Shenzhen City (CN); Jing Song, Shenzhen City (CN); Yushu Zhao, Shenzhen City (CN); Xiaolian Zhou, Shenzhen City (CN)

(73) Assignee: eMoMo Technology Co., Ltd., Shenzhen (CN)

( * ) Notice: Subject to any disclaimer, the term of this patent is extended or adjusted under 35 U.S.C. 154(b) by 1028 days.

(21) Appl. No.: 17/955,999

(22) Filed: Sep. 29, 2022

(65) Prior Publication Data

US 2023/0371707 A1 Nov. 23, 2023

(30) Foreign Application Priority Data

May 23, 2022 (CN) ..... 202221247827.9
May 23, 2022 (CN) ..... 202221261564.7

(51) Int. Cl.
*A47C 31/00* (2006.01)
*A47B 97/00* (2006.01)

(52) U.S. Cl.
CPC ..... *A47C 31/008* (2013.01); *A47B 97/00* (2013.01); *A47B 2220/0097* (2013.01)

(58) Field of Classification Search
CPC ..... A47B 2220/0097
See application file for complete search history.

(56) References Cited

U.S. PATENT DOCUMENTS

| | | | |
|---|---|---|---|
| D322,609 | S | 12/1991 | Patton |
| D417,869 | S | 12/1999 | Yasutomi |
| D443,596 | S | 6/2001 | Ohkuma |
| D552,043 | S | 10/2007 | Thursfield |
| D595,668 | S | 7/2009 | Lasky |
| D606,947 | S | 12/2009 | Caprio |

(Continued)

OTHER PUBLICATIONS

United States Patent and Trademark Office; Ex Parte Quayle Action issued in U.S. Appl. No. 29/868,160 on Dec. 4, 2023; 4 pages.

(Continued)

*Primary Examiner* — Nathan L Laughlin
(74) *Attorney, Agent, or Firm* — Womble Bond Dickinson (US) LLP

(57) ABSTRACT

A smart furniture controller may include a remote control device and a control box including a receptacle configured to receive and retain the remote control device. A first magnet may be provided within the receptacle on an inner wall of the control box, and a second magnet may be provided in the remote control device. The first magnet and the second magnet may be configured to magnetically connect when the remote control device is positioned in the receptacle. According to an aspect, the control box may include a control circuit and a wireless communication assembly. The control circuit may control a functional unit of a smart furniture item. The wireless communication assembly may be configured to send a control signal to an external receiver or to the remote control device to control a massage component of the remote control device.

19 Claims, 8 Drawing Sheets

(56) References Cited

U.S. PATENT DOCUMENTS

| | | | |
|---|---|---|---|
| D611,914 | S | 3/2010 | Chiang |
| D690,662 | S | 10/2013 | Maier |
| D733,652 | S | 7/2015 | Wenji |
| D760,177 | S | 6/2016 | Gassner |
| D779,460 | S | 2/2017 | Turksu |
| 9,640,343 | B2 | 5/2017 | Koch |
| D788,718 | S | 6/2017 | Tang |
| D801,310 | S | 10/2017 | Kachwalla |
| D804,410 | S | 12/2017 | Tang et al. |
| D805,472 | S | 12/2017 | Tang et al. |
| D852,170 | S | 6/2019 | Zhang |
| D897,968 | S | 10/2020 | Beilfuss |
| D897,969 | S | 10/2020 | Beilfuss |
| D897,970 | S | 10/2020 | Beilfuss |
| D909,315 | S | 2/2021 | Beilfuss |
| 10,925,404 | B2 | 2/2021 | Rains |
| D925,583 | S | 7/2021 | Wu |
| D929,950 | S | 9/2021 | Yu |
| D930,600 | S | 9/2021 | Zhuang |
| D977,124 | S | 1/2023 | Erdmann |
| D985,536 | S | 5/2023 | Hilaman |
| D1,003,862 | S | 11/2023 | Yang |
| 2010/0217164 | A1 | 8/2010 | Meyer |
| 2011/0138534 | A1* | 6/2011 | Kozel ..... A47C 19/00 5/499 |
| 2011/0198894 | A1 | 8/2011 | Hsieh |
| 2014/0197666 | A1 | 7/2014 | Koch |
| 2014/0306505 | A1 | 10/2014 | Koch |
| 2014/0353134 | A1 | 12/2014 | Muller |
| 2016/0120740 | A1* | 5/2016 | Rawls-Meehan .... A47C 31/008 601/49 |
| 2018/0092800 | A1* | 4/2018 | Chapman ..... A61N 2/002 |
| 2020/0168219 | A1 | 5/2020 | Tang |
| 2020/0214448 | A1 | 7/2020 | Jacobs |
| 2020/0390644 | A1* | 12/2020 | Yang ..... A61H 15/00 |
| 2023/0017775 | A1* | 1/2023 | Monaghan ..... G16H 40/67 |
| 2023/0371707 | A1 | 11/2023 | Zhou |

OTHER PUBLICATIONS

United States Patent and Trademark Office; Non-Final Office Action issued in U.S. Appl. No. 29/868,159 on Dec. 5, 2023; 6 pages.

United States Patent and Trademark Office; Notice of Allowance issued in U.S. Appl. No. 29/868,155 on Dec. 26, 2023; 7 pages.

* cited by examiner

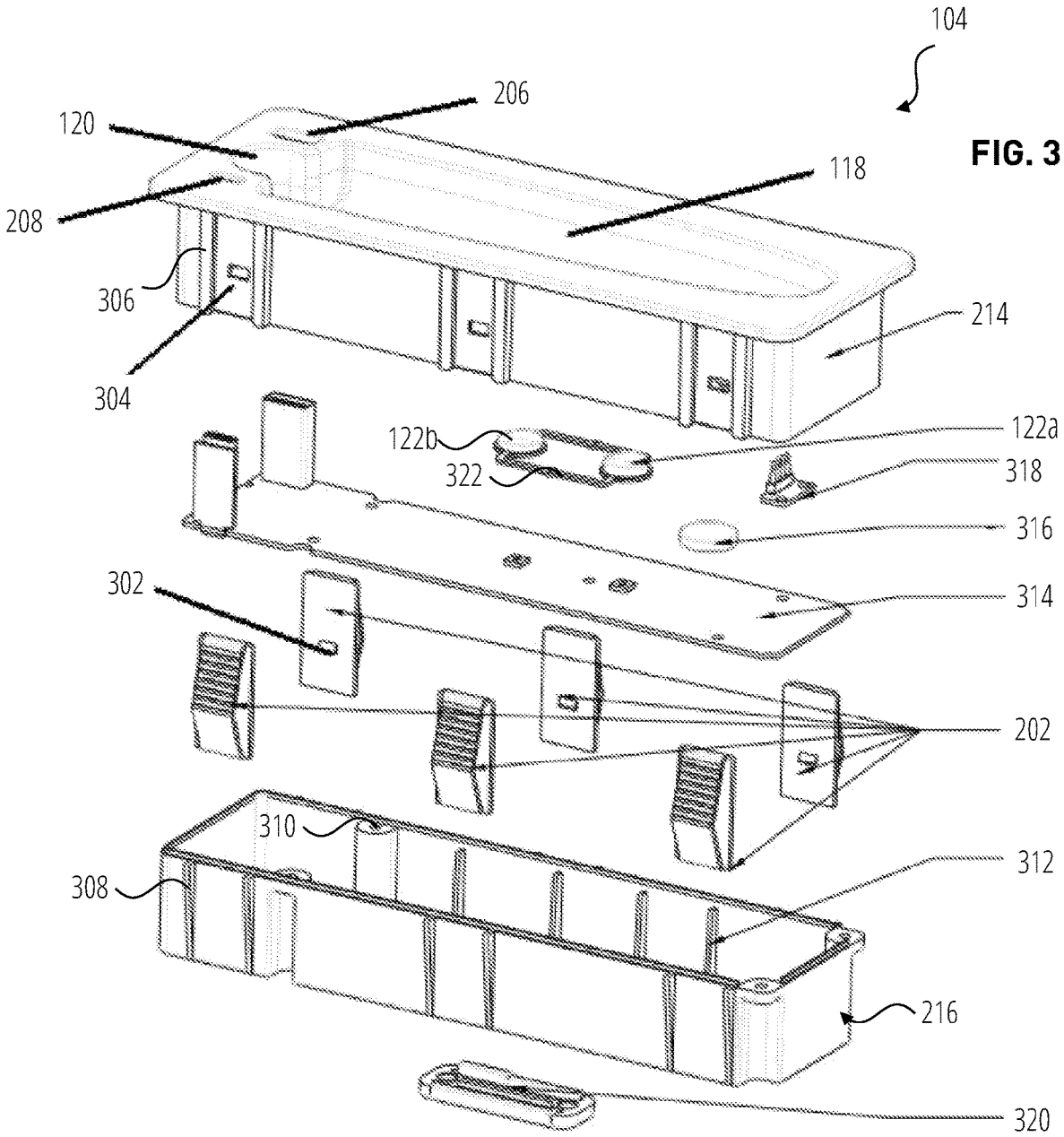
FIG. 3
FIG. 4
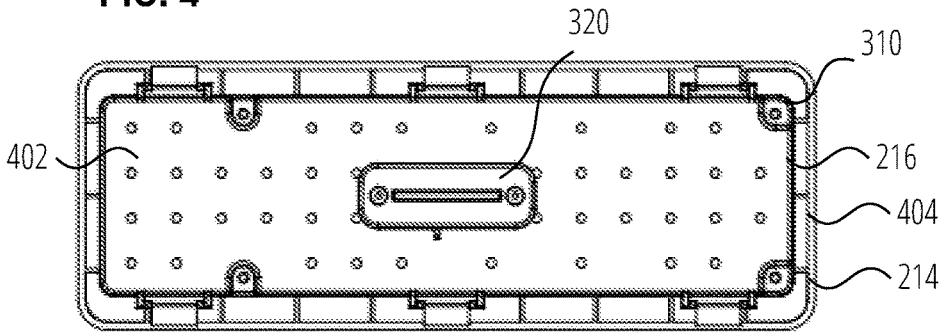

FIG. 11
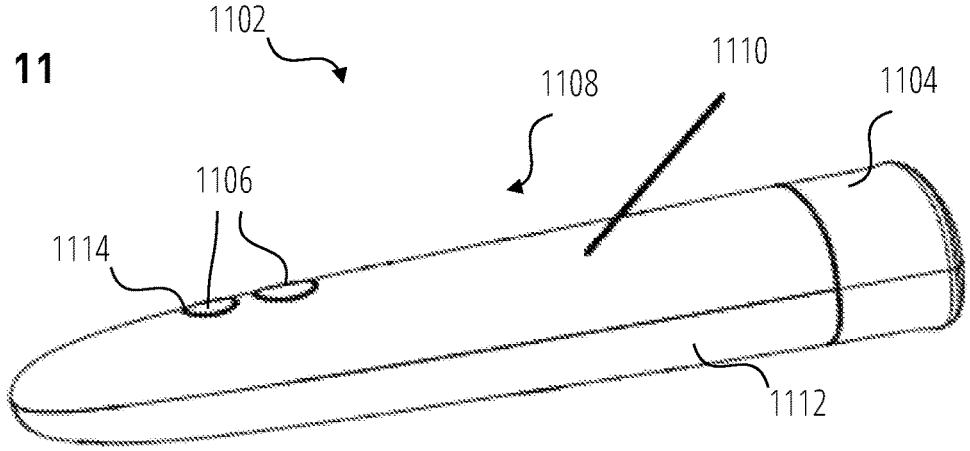
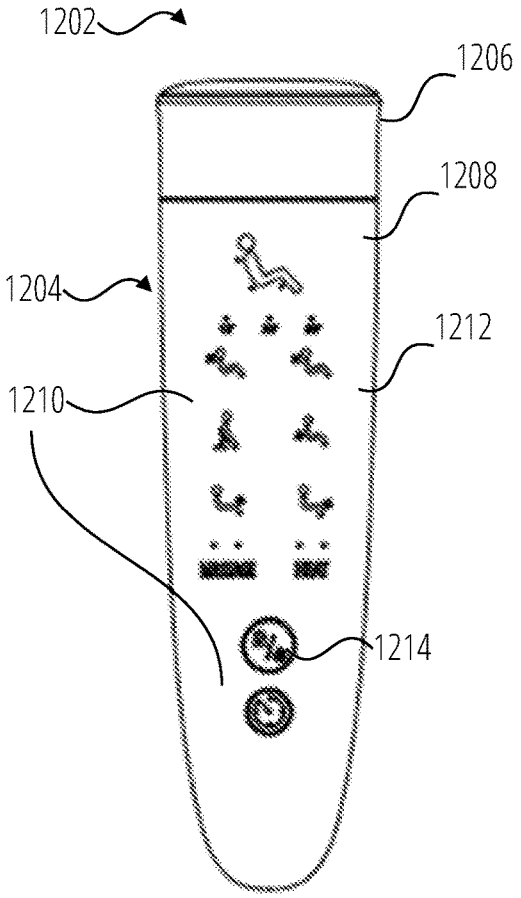
FIG. 12A
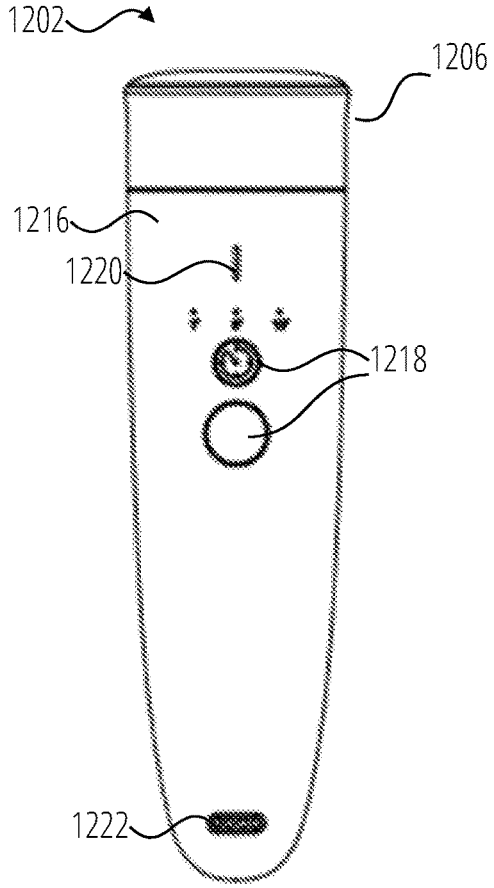
FIG. 12B

SMART FURNITURE CONTROLLER

CROSS-REFERENCE TO RELATED APPLICATIONS

This application claims priority to CN Patent Application No. 202221261564.7 filed May 23, 2022, and CN Patent Application No. 202221247827.9 filed May 23, 2022, each of which is incorporated herein by reference in its entirety.

BACKGROUND

As living standards improve, the demand for a higher quality of life is steadily increasing. Traditional furniture can no longer meet people's requirements in daily life, and as a result smart home furniture, devices, and electrical appliances have an indispensable role in the home. However, as the number of smart devices increases, there are more and more remote control devices for the various smart devices, making it easy for them to run out of battery or difficult to find when needed.

In view of this problem, a need exists for a remote control device that is multifunctional and compatible with a controller system, to provide capabilities for storage, charging, location detection, connectivity to associated smart devices, and massage and heat functionality, among other capabilities.

BRIEF SUMMARY

Embodiments of the disclosure are associated with a smart furniture controller. The smart furniture controller includes a remote control device and a control box. According to an aspect, the control box includes a receptacle configured to receive and retain the remote control device, and a first magnet provided within the receptacle. The first magnet is provided on an inner wall of the control box. The smart furniture controller may further include a second magnet provided in the remote control device. According to an aspect, the first magnet and the second magnet are configured to magnetically connect when the remote control device is positioned in the receptacle.

Additional embodiments of the disclosure are associated with a smart furniture assembly that includes a furniture item including a functional unit configured to initiate one or more of a position adjustment function, a massage function, and a heat function of the furniture item. The smart furniture assembly includes a control box provided on the furniture item. According to an aspect, the control box includes a receptacle configured to receive and retain a remote control device, a first control circuit including a first control button configured to control the functional unit of the furniture item, and a first wireless communication assembly. The smart furniture assembly further includes a remote control device including a massage component provided on the remote control device, a second control circuit including a second control button configured to control at least one of the functional unit of the furniture item and the massage component, and a second wireless communication assembly. The first wireless communication assembly is configured to send a control signal to the remote control device and the second wireless communication assembly is configured to send a control signal to the control box.

Further embodiments of the disclosure are associated with a remote control device. The remote control device includes a device body sized and shaped to be positioned in a receptacle provided in a smart furniture item, a power supply circuit, a control circuit, and a wireless communication assembly. A massage component is coupled to the device body and is electrically connected to the control circuit. According to an aspect, the remote control device further includes a first control button connected to the control circuit and configured to send a control signal to control a functional unit of the furniture item through the wireless communication assembly. A second control button may be connected to the control circuit and may be configured to send a control signal to control the massage component.

Embodiments of the disclosure are associated with a multifunctional smart furniture controller. The multifunctional smart furniture controller includes a remote control device and a control box that may be embedded in a furniture item. The remote control device and the control box may be configured for magnetic connection, which may help a user to properly store and prevent losing the remote control device when not in use. The remote control device may also have massage physiotherapy functionality. In addition, the multifunctional smart furniture controller may provide the advantages of simple installation and low labor cost.

A smart furniture controller may include a control box, a control box control circuit, a control box power supply circuit, a control box wireless communication assembly, and a remote control device.

The control box may include a receptacle for the smart furniture remote control device. A first magnet may be provided in the remote control device, and a second magnet may be provided in the receptacle. The two magnets may be connected once the remote control device is placed in the receptacle.

The control box may have one or more control buttons (or sets of control buttons) connected to the control box control circuit (i.e., the first control circuit). A first set of control buttons (i.e., a first control button) may be configured to control the smart furniture item and may send control signals to one or more functional units in the smart furniture item.

A second set of control buttons (i.e., a second control button) may send control signals through the control box wireless communication assembly (i.e., the first wireless communication assembly) to the remote control device, or to a wireless receiver that is installed on a movable household item (e.g., a phone). The wireless receiver may include an integrated alarm. After receiving the control signal from the second control button, the wireless receiver may control the alarm to initiate an alarm sound or vibration for location detection of the household item.

The control box power supply circuit (i.e., the first power supply circuit) may be provided in the control box of the smart furniture controller. An electrical connector (i.e., a first electrical connector) may be provided in the receptacle of the control box and may be connected to the first control circuit. A corresponding electrical connector (i.e., a second electrical connector) may be provided in the remote control device. The two connectors may be connected when the remote control device is placed in the receptacle.

The first wireless communication assembly may receive a control signal sent by the remote control device, and may subsequently send it to one or more functional units of the smart furniture item. The functional units of the smart furniture item may be connected to the first control circuit.

One of the control buttons provided on the control box may include a search button, which sends a location detection (or "find my remote") prompt signal to the remote control device through the first wireless communication assembly. The remote control device may include an alarm, and the remote control device may control the alarm to initiate an alarm sound or vibration after receiving the search prompt signal.

The control box may include an upper box body and a lower box body. A charging interface may be provided on the control box.

Multiple side walls of the upper box body or of the lower box body may include two or more elastic components. The elastic components may be made of rubber, plastic, resin, or metal. A cross-section shape of the elastic components may be triangular or bowed, and the whole or part of the surface of the elastic components may flat, saw-toothed, or wavy.

The control box may have a regular (i.e., symmetrical) three-dimensional structure, which may be rectangular, cube-shaped, cylindrical, or elliptic. The control box may have an irregular (i.e., asymmetrical) three-dimensional structure, such as a pocket, pistol, or axe shape. The relative positions of the upper box body and the lower box body may be superimposed up and down, or nested from inside to outside.

The control box may be pocket-shaped. An inclined receptacle surface may be provided for placing the remote control device in the receptacle. The position of the opening of the receptacle may give the remote control device an angle of more than 5 degrees and less than 90 degrees from an upper surface of the upper box body. A removal access portion may be provided adjacent to the receptacle for ease of removal of the remote control device from the receptacle.

A smart furniture controller may include a remote control device configured for connection to a control box (e.g., a magnetic connection to a control box). The remote control device may include a device body, a first set of remote control device control buttons, a second set of remote control device control buttons, a remote control device control circuit (i.e., a second control circuit), a remote control device power supply circuit (i.e., a second power supply circuit), a remote control device wireless communication assembly (i.e., a second wireless communication assembly) and/or one or more functional units, including a massage component.

The first set of control buttons and the second set of control buttons may be provided on the remote control device and may be connected to the second control circuit. The first set of control buttons may send a control signal through the second wireless communication assembly to the control box, to control one or more functional units of the furniture item. The second set of control buttons may send a control signal to the massage component through the second control circuit.

The first wireless communication assembly may receive signals sent by the second wireless communication assembly to control the functional units of the smart furniture item.

The first wireless communication assembly may also send signals to the remote control device. For example, the remote control device may include an alarm (e.g., a buzzer), and the second wireless communication assembly may send a control prompt to the alarm after receiving a signal sent by the smart furniture controller to confirm a location of the remote control device.

The device body of the remote control device may include an upper shell and a lower shell, which may be coupled together to form a cavity. The first set of remote control device control buttons and the second set of remote control device control buttons may be provided on the upper shell and the lower shell, respectively.

The massage component of the remote control device may include a top cover, a massage head, a massage head support, a vibrating element, a heating element, and a temperature control probe. The massage head, vibrating element, heating element, and temperature control probe may be coupled to the massage head support, and the massage head support may be attached to a fixed support. The top cover may cover the fixed support.

The massage head may be made from stone, jade, salt, precious metal or silica gel. There may be at least one massage head provided on the remote control device. The heating element may be a semiconductor type heating element. The vibrating element may be driven by a vibration motor.

The second power supply circuit may include a remote control device power supply, e.g., a battery, such as a lithium battery, an alkaline battery, a nickel cadmium battery or a nickel hydrogen battery, or a charging module, such as a USB charging module, a type-C charging module or an electromagnetic induction charging module. An interface for the charging module may be provided on the upper shell or the lower shell of the remote control device.

The remote control device may be placed in the receptacle of the control box in a smart furniture item. The first electrical connector provided in the receptacle of the control box and the second electrical connector provided on the remote control device may be connected when the remote control device is placed in the receptacle. The remote control device may further include a magnet. The control box may include a magnet in the receptacle, and the two magnets may be connected when the remote control device is placed in the receptacle. When the remote control device is positioned in the receptacle, the first electrical connector may electrically connect to the second electrical connector to complete an electrical circuit.

The control box may be installed in a furniture item by a tension or clamping engagement between the furniture item and the elastic components of the control box, i.e., without screws, reducing installation time.

The remote control device may include the functionality of both a smart furniture controller and a massager, which further improves the user experience of the smart furniture item in terms of comfort and health.

The smart furniture controller includes a suitable control box that is configured to receive and store the remote control device. The remote control device and the control box may be coupled together using magnets to prevent the loss of the remote control device when not in use.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which:

FIG. 3 is an exploded view of the control box of FIG. 2, according to an embodiment;

FIG. 4 is a bottom plan view of the control box of FIG. 2, according to an embodiment;

FIG. 11 is a perspective view of a remote control device, according to an embodiment;

FIG. 12A is a top plan view of the remote control device of FIG. 11, according to an embodiment;

FIG. 12B is a bottom plan view of the remote control device of FIG. 11, according to an embodiment; an aspect according to an embodiment;

Figure 1A:
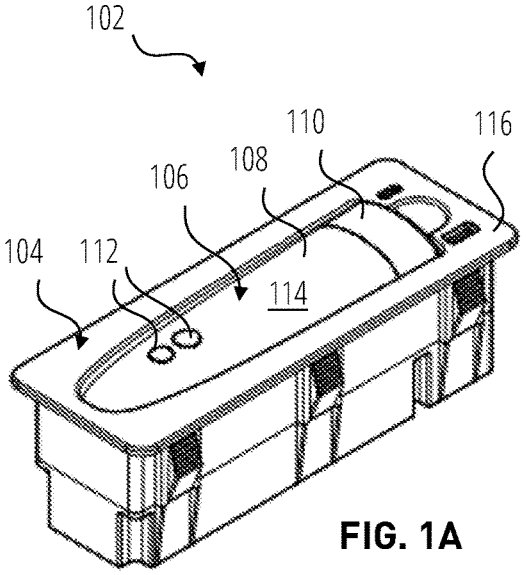
FIG. 1A is a perspective view of a smart furniture controller, showing a remote control device positioned in a control box, according to an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to aid in understanding the features of the exemplary embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments. It is understood that reference to a particular "exemplary embodiment" of, e.g., a structure, assembly, component, configuration, method, etc. includes exemplary embodiments of, e.g., the associated features, subcomponents, method steps, etc. forming a part of the "exemplary embodiment".

For purposes of this disclosure, "connected" means in electrical contact or communication, except where the disclosure makes clear that "connected" refers to a purely physical connection. Electrical contact or communication includes, for example and without limitation, one or more physical connections between conductive components, either directly or through intermediate conductive components or relays, and wireless communication such as by Bluetooth transmission or the like, and/or as described for particular aspects of this disclosure. Electrical contact or communication may provide, for example and without limitation, a path for transmission of electrical power, digital signals, one-way or two-way communication via radio waves, and the like.

Where the disclosure makes clear that "connected" refers to a purely physical connection or joining, "connected", for purposes of this disclosure, means integrally formed, or securely, separably, or removably joined by known techniques consistent with the disclosure.

For purposes of this disclosure, relative terms including, without limitation, "top", "bottom", "upper", "lower", "above", "below", "within", etc. are used to aid the description of, e.g., configurations of features as shown in the accompanying figures, and otherwise as the disclosure makes clear. Such relative terms do not imply any particular dimension or delineation of or between features except where the disclosure makes clear.

Embodiments described herein relate generally to devices, systems, and methods for smart furniture control including voice recognition. For purposes of this disclosure, the phrases "devices," "systems," and "methods" may be used either individually or in any combination referring without limitation to disclosed components, grouping, arrangements, steps, functions, or processes.

For purposes of illustrating features of the embodiments, an exemplary embodiment will now be introduced and referenced throughout the disclosure. It will be understood that this example and other exemplary embodiments described in this disclosure are illustrative and not limiting and are provided purely for explanatory purposes.

FIG. 1A shows a smart furniture controller 102, including a control box 104 and a remote control device 106 positioned within the control box 104. In an embodiment, the control box 104 of the smart furniture controller 102 may be installed in a smart furniture item, such as, for example and not limitation, a sofa, a chair, an armrest, a bed, and the like. The smart furniture controller 102 (i.e., the control box 104 and the remote control device 106) may be configured to control one or more functional units associated with or installed in or on the smart furniture item. Functional units may include, for example and not limitation, position adjustment functions (e.g., seat angle, seat elevation, mattress angle, mattress elevation, footrest angle, footrest elevation), massage functions, heating functions, and the like.

The remote control device 106 may include a device body 108 and a massage component 110 positioned at an end of the device body 108. The remote control device 106 may be shaped and sized to be received and retained within the control box 104. In an aspect, a top surface 114 of the remote control device 106 may be substantially even with an upper surface 116 of the control box 104. A first set of remote control device control buttons 112 may be provided on the device body 108. In an aspect, the first set of remote control device control buttons 112 may be positioned away from the massage component 110, for example, near an end of the device body 108 opposite the massage component 110. The first set of remote control device control buttons 112 may be configured to send a control signal to control a functional unit of the furniture item.

Figure 1B:
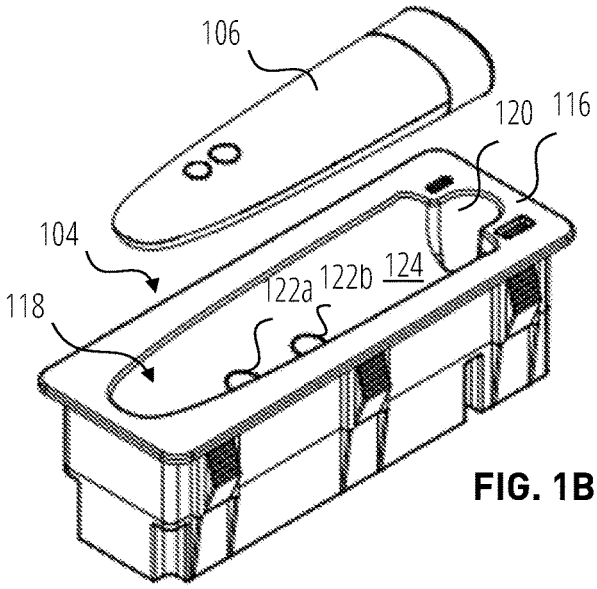
FIG. 1B is a perspective view of a smart furniture controller according to FIG. 1A, showing the remote control device separated from the control box, according to an embodiment.

FIG. 1B shows the remote control device 106 after being removed from the control box 104. In an aspect, a receptacle 118 may be formed in the control box 104 to receive and retain the remote control device 106. In the exemplary embodiment, the receptacle 118 may be provided as a horizontal slot formed in an upper surface 116 of the receptacle 118. A removal access portion 120 may be provided adjacent to the receptacle 118 for taking the remote control device 106 out of the receptacle 118.

One or more control buttons 122*a*, 122*b* may be provided on the control box 104, for example, on a wall 124 of the control box 104 that defines the receptacle 118. The one or more control buttons 122*a*, 122*b* may be configured to send a control signal to one or more of the smart furniture item, the remote control device 106, and a wireless receiver coupled to a movable household item. While two remote control device control buttons 122*a*, 122*b* are shown, it is contemplated that the control box 104 may have more than two control buttons, for example, a first set of remote control device control buttons and a second set of remote control device control buttons wherein each set includes more than one control button.

Figure 2:
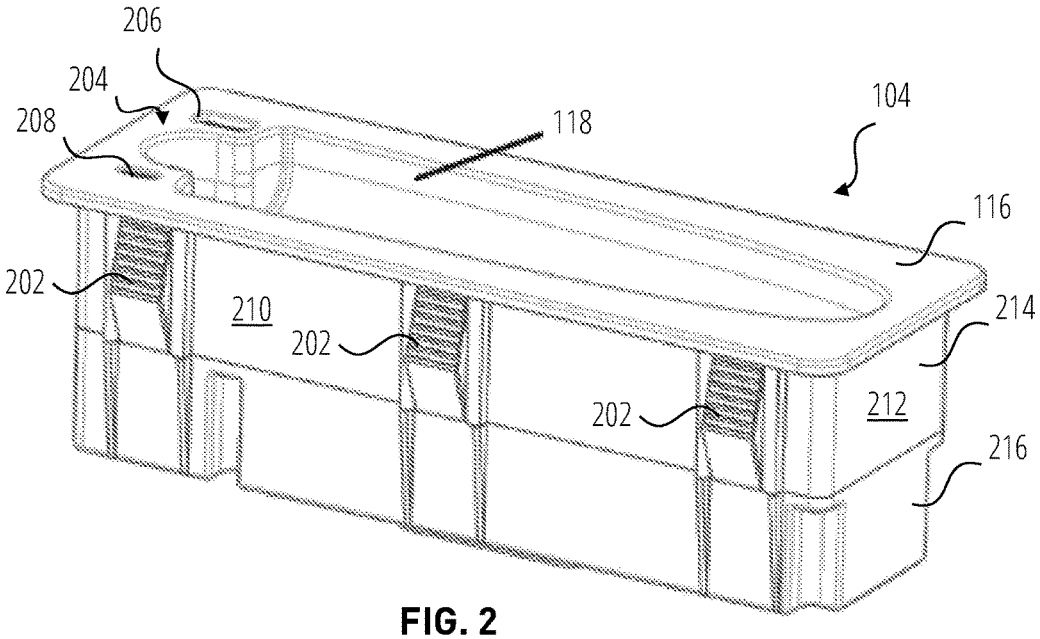
FIG. 2 is a perspective view of a control box, according to an embodiment.

FIG. 2 shows a detailed view of the control box 104 according to an exemplary embodiment. The control box 104 may include an upper box body 214 and a lower box body 216. The upper surface 116 may be provided as part of the upper box body 214. On the upper surface 116 there may be provided a charging interface 204, which may include electrical power connections, for example, USB charging module 206 and type-C charging module 208. The charging interface 204 may be configured to provide electrical power to an electrical accessory, such as a mobile device (for example, a cellphone or a tablet).

An elastic component 202, may be provided on one or more side walls of the upper box body 214 and/or the lower box body 216. In the exemplary embodiment, elastic components 202 are provided on the upper side wall 210 of the upper box body 214. In an aspect, the elastic components 202 may be made of rubber, plastic, resin, or metal. To install the control box 104 in the furniture item, an opening corresponding in shape and size to the upper box body 214 and/or lower box body 216, and corresponding slots matching the width of the elastic components 202, are formed in a body of the furniture item. Upon positioning of the control box 104 in the furniture item, the elastic components 202 may be resiliently deformable to engage the furniture item and secure the control box 104 in position in the furniture item by clamping the control box 104 in a tension fit engagement to the body of the furniture item. The cross-section shape of the elastic components 202 may triangular or bowed. An entire surface, or part of the surface, of the elastic components may be flat, saw-toothed or wavy.

In the exemplary embodiment, the control box 104 may have a cuboidal configuration. The control box 104 in an aspect may be provided as a regular (i.e., symmetrical) three-dimensional figure, for example, rectangular, cube-shaped, cylindrical, or elliptic, or as an irregular three-dimensional structure, for example, as a pocket, pistol, or axe shaped. The position of the upper box body 214 relative to the lower box body 216 may be any of the following: the upper box body 214 may be superimposed above or below the lower box body 216; the upper box body 214 may be nested within the lower box body 216; and the lower box body 216 may be nested within the upper box body 214.

The control box 104 may be installed in the smart furniture item so that if the control box 104 is embedded in the furniture item, an upper surface 116 of the control box 104 is substantially flat against an adjacent surface of the furniture item.

FIG. 3 shows an exploded view of the control box 104 of FIG. 2. With continuing reference to the upper box body 214 and the lower box body, FIG. 3 shows six elastic components 202 spaced apart for attaching evenly along two opposing side walls of the upper box body 214. The opposing side walls of the upper box body 214 may have provided thereon one or more corresponding tracks 306 to receive one of each of the elastic components 202. Each track 306 may include a fixed port 304, and each elastic component 202 may include a fixed buckle 302 such that when an elastic component 202 is positioned in a corresponding track 306, the fixed buckle 302 engages with the fixed port 304 to couple the elastic component 202 to the upper box body 214. The lower box body 216 may further include corresponding projections 308 that are dimensioned to align with the tracks 306 provided on the upper box body 214.

The upper box body 214 and the lower box body 216 may be coupled together by any known means. For example, and not limitation, the lower box body 216 may include one or more screw holes 310 and the upper box body 214 may include a corresponding one or more screw holes (not shown). The upper box body 214 may be stacked on top of the lower box body 216 and screwed or bolted together.

When coupled together, a cavity 312 may be formed within the control box 104. The cavity 312 may house a main control printed circuit board assembly ("main control PCBA") 314, a magnet 316, a first electrical connector 318, and one or more control buttons 122*a*, 122*b*.

The main control PCBA 314 may be installed between the upper box body 214 and the lower box body 216, and may be integrated with each of a first control circuit and a first wireless communication assembly provided in the control box 104.

The magnet 316 may be provided along an inner wall of the receptacle 118. As discussed below, the magnet 316 may be positioned to couple with a magnet provided in the remote control device 106 when the remote control device 106 is positioned in the receptacle 118. In an aspect, the magnet 316 may be provided as a single magnet.

An electrical connector 318 may be provided in the control box 104 and connected to the main control PCBA 314. The electrical connector 318 may be a spring pin component. A hole may be formed in the wall 124 of the upper box body 214, through which the electrical connector 318 may be provided so that the electrical connector 318 extends partially into the receptacle 118. The electrical connector 318 may be configured to electrically connect to the remote control device 106 when the remote control device 106 is positioned in the receptacle 118.

As shown in FIG. 1B, control box control button 122*a* and control box control button 122*b* may be provided in the control box 104. The wall 124 of the receptacle 118 may have holes formed thereon through which the control button 122*a*, 122*b* may be positioned. In an aspect, the control button 122*a*, 122*b*, may include button covers that may be linked together as a unitary insert 322 so that the control buttons 122*a*, 122*b* are more easily retained in position in the holes.

Each of the control button 122*a* and control button 122*b* may be connected to the first control circuit. In an aspect, a first control button 122*a* may be connected to the smart furniture item to send a control signal (e.g., reset signal) to the functional units of the furniture item. For example and not limitation, the first control button 122*a* may be a reset button connected to the furniture item and may be configured to send a control signal to reset a saved memory setting of a functional unit of the furniture item.

A second control button 122*b* may be configured to send a control signal to the remote control device 106 through the first wireless communication assembly. In an embodiment, the control button 122*b* may be a search button configured to send a prompt signal to the remote control device 106 and/or to a wireless receiver associated with a movable household item, through the first wireless communication assembly. In this implementation, the control box 104 may be used to locate the remote control device 106, or another item equipped with a compatible wireless receiver, if its location is unknown. When the search button 122*b* on the control box 104 is pressed, the main control PCBA 314 sends a "find my remote" prompt to the surroundings through the wireless communication assembly. After receiving the prompt sent by the control box 104, the remote control device 106 or the object attached to the wireless receiver or with a complementary built-in receiver assembly may prompt the user by activating an alarm integrated with the receiver (for example, initiating on the alarm, emitting light or vibrations, and the like).

In an embodiment, the control button 122*a* that is connected to the furniture item may be provided as a first set of control buttons, and the control button 122*b* configured to send a control signal through the first wireless communication assembly may be provided as a second set of control buttons.

The control box 104 may also include a first power supply circuit that is connected to the main control PCBA 314. The first power supply circuit may include a power supply, e.g., a wire block 320, that may be provided outside the bottom of the lower box body 216 and may provide an electrical connection to an external power source. The first power supply circuit may also include the charging interface 204 (e.g., type-C charging module 208 and USB charging module 206) so that power may be provided to the charging interface 204 from the wire block 320. The wire block 320 may also connect to the functional units of the furniture item to provide power to, for example, motors, heating elements, massage elements, and the like.

FIG. 4 shows a bottom plan view of the control box 104 of FIG. 3. A bottom panel 402 may be provided to define a lower boundary of the cavity 312 provided in the control box 104. The wire block 320 may be positioned on the bottom panel 402 and secured thereto by any known means, such as, for example, fasteners or screws. The wire block 320 may be connected to the main control PCBA 314 through the bottom panel 402. As shown in FIG. 4, the control box 104 may also include a lip 404 provided as a portion of the upper box body 214, which extends beyond an outer perimeter of the lower box body 216. The lip 404 may be positioned against a surface of the smart furniture item when the control box 104 is installed in the furniture item.

Figure 5A:
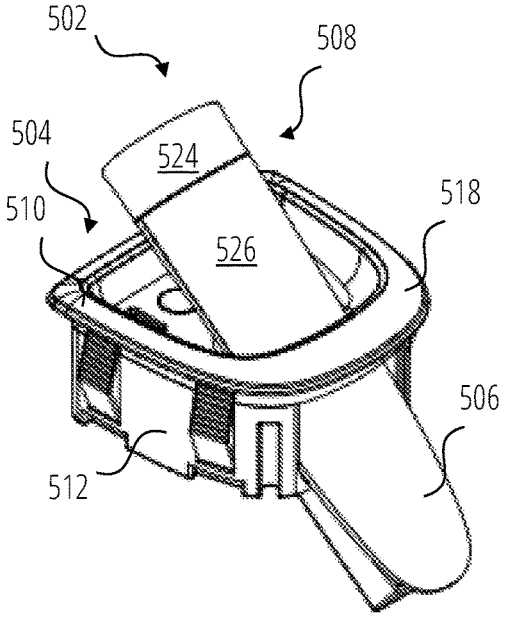
FIG. 5A is a perspective view of a smart furniture controller, showing a remote control device positioned in a control box, according to an embodiment.

FIG. 5A shows a smart furniture controller 502 including a control box 504 and a remote control device 508 positioned within the control box 504. In the exemplary embodiment that FIG. 5A shows, the control box 504 and remote control device 508 are substantially as has been described with respect to FIG. 1A, and common features will not be repeated in detail here. The control box 504 may include a lower box body 512 and a receptacle 506 extending through and away from the lower box body 512. An upper box body 510 may be coupled to the lower box body 512 to form the control box 504. The control box 504 may be defined at an upper end by an upper surface 518 extending around a perimeter of the upper box body 510. The receptacle 506 may be configured to receive and retain the remote control device 508 and in an aspect, the massage component 524 and a portion of the device body 526 of the remote control device 508 may extend at least partially beyond the upper surface 518 of the control box 504 when it is positioned in the receptacle 506.

Figure 5B:
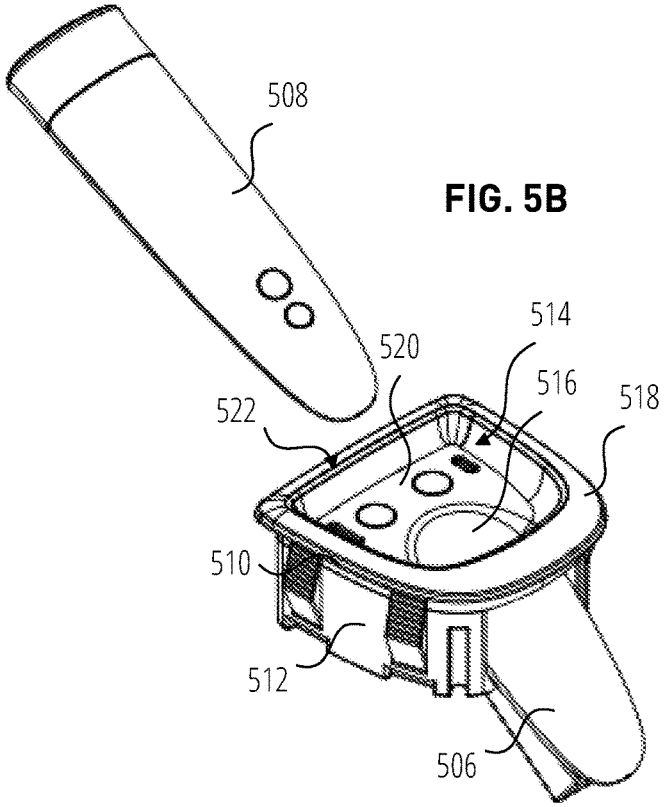
FIG. 5B is a perspective view of a smart furniture controller according to FIG. 5A, showing the remote control device separated from the control box, according to an embodiment.

FIG. 5B shows the remote control device 508 after being removed from the control box 504. In the exemplary embodiment, a recess 514 may be formed in the control box 504 that is defined at a lower end by a recessed surface 520. An upper end of the recess 514 may include a portion of the upper box body 510 and the upper surface 518 of the control box 504, which may extend around the recess 514. In an aspect, the recess 514 may have a slightly larger perimeter compared to an inner edge of the upper surface 518, so that a lip 522 may be formed by the upper surface 518 where it extends over and partially covers a perimeter portion of the recess 514.

The receptacle 506 may be defined by an inclined surface 516 that extends from the recessed surface 520 in a direction away from the upper box body 510. In an aspect, the angle between the inclined surface 516 of the receptacle 506 and the upper surface 518 and/or the recessed surface 520 of the control box 504 may be greater than about 5 degrees and less than about 90 degrees. When the remote control device is positioned in the receptacle 506, the remote control device may be positioned at an inclined angle that is greater than 5 degrees and less than 90 degrees relative to the upper surface 518 of the upper box body 510.

Figure 6:
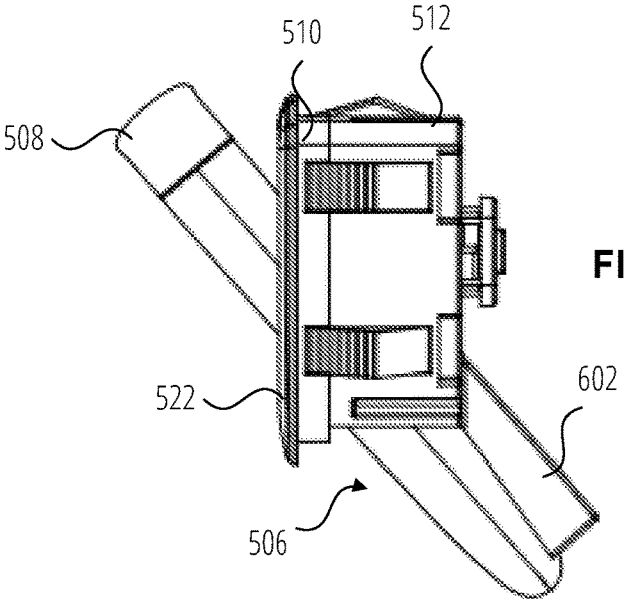
FIG. 6 is a side elevation view of a smart furniture controller, according to an embodiment.

FIG. 6 shows a side view of the smart furniture controller 502 including the remote control device 508 positioned in the control box 504. The relative position or angle of the receptacle 506 to the upper box body 510 and lower box body 512 is shown in the exemplary embodiment at about 45 degrees. FIG. 6 also shows a receptacle frame 602 provided adjacent the receptacle 506, which extends from the lower box body 512. The receptacle frame 602 may house one or more components of the smart furniture controller 502, including, for example and not limitation, a magnet and an electrical connector as described in detail below.

Figure 7:
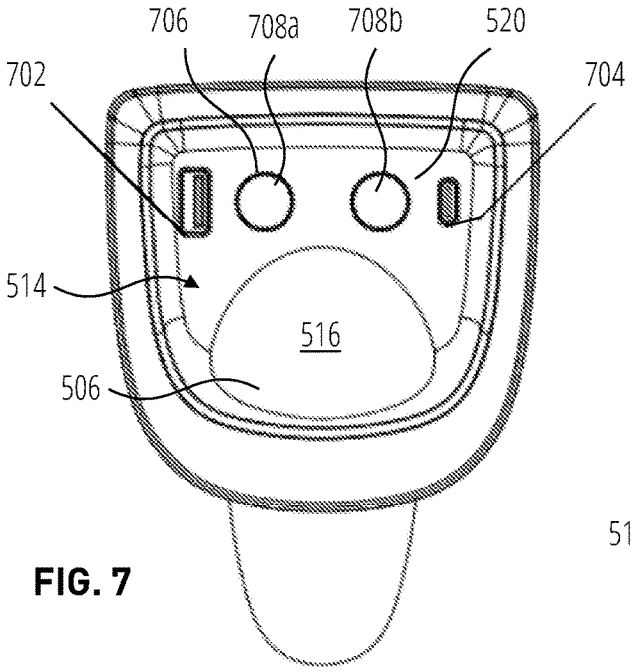
FIG. 7 is a top plan view of the control box of FIG. 6, according to an embodiment.

With reference to FIG. 7, one or more holes 706 may be formed on the recessed surface 520 and control buttons 708*a*, 708*b* may be provided through the holes 706. A charging interface, including a USB charging module 702 and a type-C charging module 704 may also be provided on the recessed surface 520.

Figure 8:
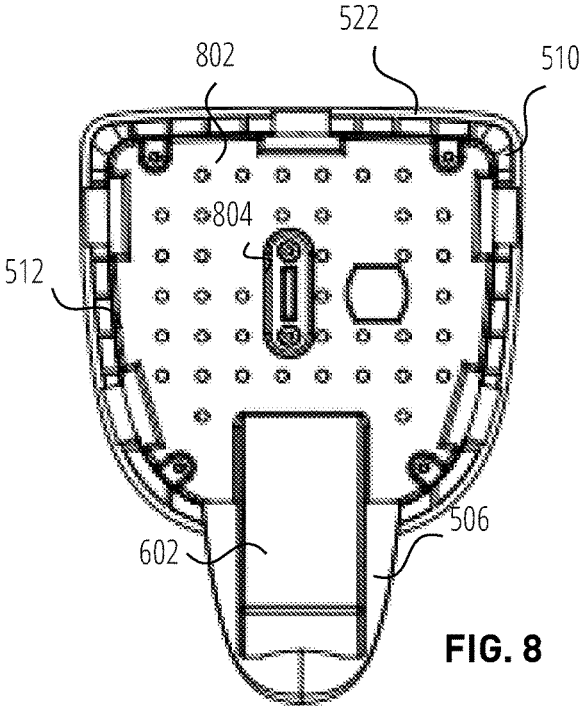
FIG. 8 is a bottom plan view of the control box of FIG. 6, according to an embodiment.

FIG. 8 shows a bottom plan view of the control box 504. A bottom panel 802 may be provided to define a lower boundary of the control box 504. The wire block 804 may be connected to a control box control circuit, as described in detail below. The wire block 804 may connected to components housed inside the control box 504 through the bottom panel 802. The control box 504 may also include a lip 522 provided as a portion of the upper box body 510, which extends beyond an outer perimeter of the lower box body 512. The lip 522 may be positioned against a surface of a furniture item when the control box 504 is installed in the furniture item to secure the control box 504 against the surface of the furniture item.

Figure 9:
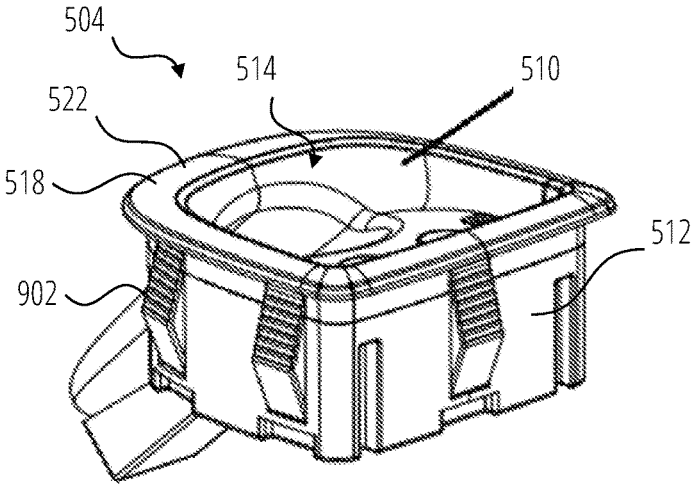
FIG. 9 is a perspective view of a control box, according to an embodiment.

FIG. 9 shows a perspective view of the control box 504 according to an embodiment. In the exemplary embodiment that FIG. 9 shows, the control box 504 is substantially as has been described with respect to FIG. 2 and FIG. 3, and common features will not be repeated in detail here. The control box 504 may be provided in a pocket shape and may include an upper box body 510 and a lower box body 512. The upper box body 510 may be provided in the shape of a horseshoe, as best shown in FIG. 7. The lower box body 512 may include multiple elastic components 902 spaced apart from one another for attaching evenly along multiple side walls of the lower box body 512.

Figure 10:
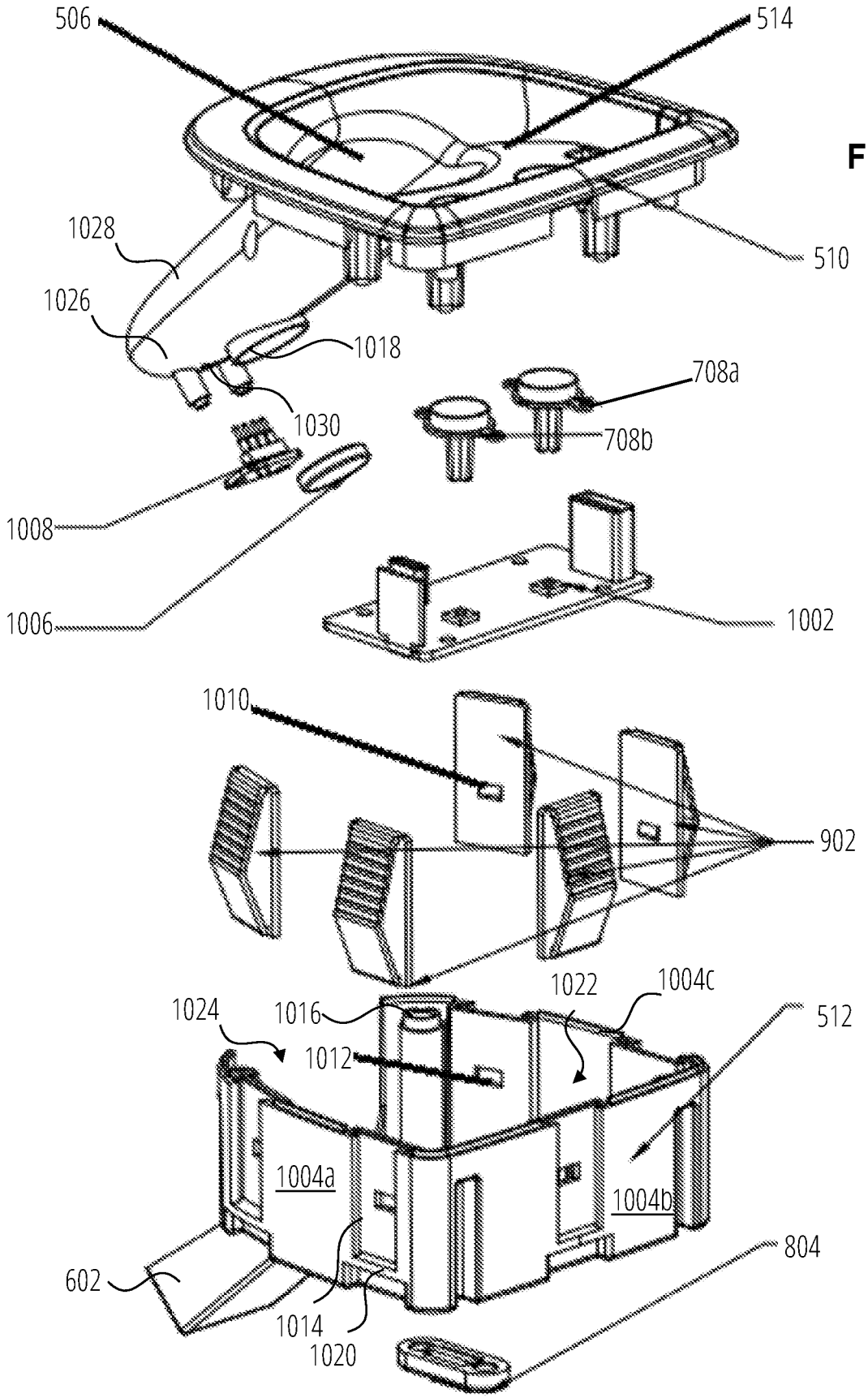
FIG. 10 is an exploded view of a control box, according to an embodiment.

FIG. 10 shows an exploded view of the control box 504 of FIG. 5A through FIG. 9. As illustrated in FIG. 10, the multiple side walls 1004*a*, 1004*b*, 1004*c* may be connected to each other in such a configuration that multiple side walls 1004*a*, 1004*b*, 1004*c* form a general U-shape. According to an aspect, each side wall 1004*a*, 1004*b*, 1004*c* of the lower box body 512 may have a corresponding receiving track 1014 that is sized and shaped to receive one of each of the elastic components 902. In an aspect, the receiving track 1014 may be defined by a portion of the side wall that is recessed towards an interior of the lower box body 512, and a bottom support wall 1020 against which the elastic component 902 may rest when it is in position in the receiving track 1014. Each receiving track 1014 may include a fixed port 1012, and each elastic component 902 may include a fixed buckle 1010 for complementarily engaging and securing the elastic component 902 to the lower box body 512.

In an assembled configuration, the upper box body 510 may be nested inside the lower box body 512 and secured together with bolts/screws provided in screw holes 1016. When assembled, a cavity 1022 may be provided in which the control buttons 708*a*, 708*b*, a main control PCBA 1002, magnet 1006, and first electrical connector 1008 may be positioned. The receptacle 506 may include an upper shell 1028 and a lower shell 1026 that are coupled together to form the receptacle 506. A magnet retention portion 1018 may be provided on the lower shell 1026 of the receptacle 506, and may be sized and shaped to receive and retain the magnet 1006 for magnetic connection with the remote control device when the remote control device is positioned in the receptacle 506. A hole 1030 may be provided in the lower shell 1026, through which the first electrical connector 1008 may be provided so that the electrical connector 1008 extends partially into the receptacle 506. The electrical connector 1008 may be configured to electrically connect to the remote control device when the remote control device is positioned in the receptacle 506.

A gap 1024 may be formed between side wall 1004*a* and side wall 1004*b* of the lower box body 512 to provide a space in which the inclined receptacle 506 may be positioned when the upper box body 510 is nested inside the lower box body 512. The receptacle frame 602 may extend from a base of the lower box body 512 adjacent the gap 1024 at an incline corresponding to that of the receptacle 506. The receptacle frame 602 may be sized and shaped to receive the receptacle 506 when the control box 504 is in an assembled configuration. The receptacle frame 602 may house the electrical connector 1008 and the magnet 1006 so that each is in close proximity for connection to the remote control device within the receptacle 506.

FIG. 11 shows a remote control device 1102 according to an exemplary embodiment. The remote control device 1102 may include a device body 1108 and a massage component 1104 positioned at an end of the device body 1108. The remote control device 1102 may be shaped and sized to be received and retained within a control box receptacle as described herein. In an aspect, the device body 1108 may include an upper shell 1110 and a lower shell 1112 that may be coupled together to provide the device body 1108. A first set of control buttons 1106 may be provided on the upper shell 1110 of the device body 1108. In an aspect, the first set of control buttons 1106 may be positioned away from the massage component 1104, for example, near an end of the device body 1108 opposite the massage component 1104. The first set of control buttons 1106 may positioned in holes 1114 formed in the upper shell 1110. The first set of control buttons 1106 may be configured to send a control signal to control a functional unit of the furniture item as described herein.

FIG. 12A and FIG. 12B show a remote control device 1202 according to an exemplary embodiment. FIG. 12A shows a top view of an upper shell, including the first set of control buttons 1210. For purposes of this disclosure, a control button, including buttons shown in the set of control buttons 1210, may include any kind of button that can be configured as a switch to open or close an electrical circuit associated with at least one of the remote control device 1202 and with the control box. In an exemplary embodiment, some buttons (i.e., control button 1214) may be provided as mechanical touch buttons that are positioned in holes formed in the device body 1204 and that are configured to be depressed to contact a circuit board contact to send a control signal through a control circuit (i.e., remote control device control circuit). Alternatively, seat adjustment button 1212 may be provided as a touch button. The first set of control buttons 1210 may include buttons that are configured control the functional units of the furniture item, including, for example, seat angle adjustment button, massage function button, heating function button, reset button and lock button. Massage function options may include pushing, pressing, kneading and other massage methods. Different temperatures or parts of the user's body to be heated may be selected, such as, for example, the neck, shoulder, waist, back, legs, feet, etc., using the heating function.

FIG. 12B shows the lower shell 1216 of the remote control device 1202, which includes a second set of control buttons 1218. The second set of control buttons 1218 may be configured to send a control signal to the massage component 1206. An indicator light 1220 may be provided on the lower shell 1216 and/or the upper shell 1208 to indicate a power mode (on/off) and/or current settings selected by the user.

An electrical connector 1222 may be provided on the lower shell 1216 towards an end of the device body 1204 opposite the massage component 1206. The electrical connector 1222 may be configured to connect to an electrical connector provided in the receptacle of the control box when the remote control device 1202 is positioned in the receptacle.

Figure 13:
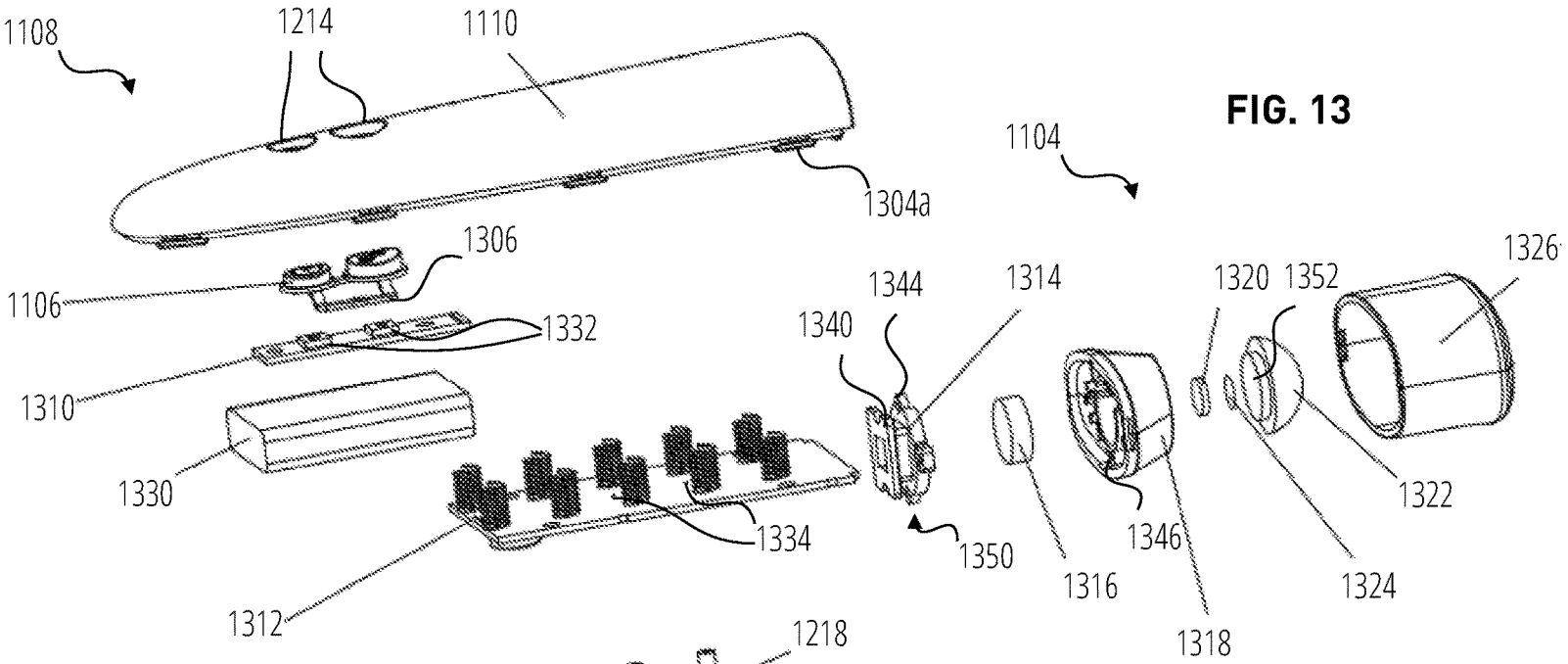
FIG. 13 is a perspective view of a remote control device, according to an embodiment.

FIG. 13 shows an exploded view of the device body 1108 and the massage component 1104 of the remote control device 1102 of FIG. 11, according to an exemplary embodiment. The device body 1108 may include an upper shell 1110 and a lower shell 1112. The upper shell 1110 and the lower shell 1112 may be coupled together to form a cavity 1302 within which internal components of the device body 1108 may be positioned. In an aspect, the upper shell 1110 and the lower shell 1112 may be coupled together with, for example and not limitation, fasteners, screws, and the like. In an aspect, complementary projections 1304*a* and divots 1304*b* may be provided on the upper shell 1110 and the lower shell 1112, respectively, that provide a snap fit engagement for securing together the upper shell 1110 and the lower shell 1112.

Components may be provided in the cavity 1302 of the device body 1108, including, for example, the first set of control buttons 1106, a second set of control buttons 1218, a button printed circuit board assembly ("button PCBA") 1310, a main control printed circuit board assembly ("main control PCBA") 1312, an electrical connector 1338, a battery 1330, and a magnet 1328.

The first set of control buttons 1106 may be provided on the upper shell 1110. The first set of control buttons 1106 may include button covers (e.g., rubberized covers) that may be linked together as a unitary insert 1306 so that the control buttons 1106 are more easily retained in position in the control buttons 1214. The first set of control buttons 1106 may be positioned or arranged on an inner wall (not shown) of the upper shell 1110.

A second set of control buttons 1218 may be provided on the lower shell 1112 of the device body 1108 in a manner similar to the first set of control buttons 1106 as described above. Similar to the first set of control buttons 1106, the second set of control buttons 1218 may be provided in holes formed in the lower shell 1112 so that the second set of control buttons 1218 is arranged on an inner wall 1308 of the lower shell 1112.

A button PCBA 1310 may be provided in the cavity 1302 adjacent the first set of control buttons 1106. The button PCBA 1310 may be configured to receive a control signal from the first set of control buttons 1106. A contact 1332 may be provided on the button PCBA 1310 for each of the buttons provided in the first set of control buttons 1106. In an aspect, when a user pushes a button from the first set of control buttons 1106, the button contacts the corresponding contact 1332 of the button PCBA 1310 to send the control signal, which is received by the button PCBA 1310.

The button PCBA 1310 may be electrically connected to the main control PCBA 1312. The main control PCBA 1312 in turn may be electrically connected to each of the second set of control buttons 1218, and the massage component 1104.

The main control PCBA 1312 may be configured to receive a control signal from the second set of control buttons 1218. In an aspect, a contact 1334 may be provided on the main control PCBA 1312 for each of the buttons provided in the second set of control buttons 1218. When a user pushes a button from the second set of control buttons 1218, the button contacts the corresponding contact 1334 of the main control PCBA 1312 to send the control signal, which is received by the main control PCBA 1312.

The remote control device 1102 may also include a remote control device control circuit (i.e., a second control circuit) and a remote control device wireless communication assembly (i.e., a second wireless communication assembly) integrated with the main control PCBA 1312. The second control circuit may be configured to receive a signal from a control button, and send the signal to a functional unit. In an aspect, each of the first set of control buttons 1106 and the second set of control buttons 1218 may be configured to send a control signal through the second control circuit to the massage component 1104 and/or to functional units provided in the furniture item.

An electrical connector 1338 (i.e., a second electrical connector) may be connected to the main control PCBA 1312. In an exemplary embodiment, the electrical connector 1338 may include a first spring pin 1336*a* that may connect to the main control PCBA 1312. The electrical connector 1338 may include a second spring pin 1336*b* configured for electrical connection with an internal or external component. In an embodiment, the second spring pin 1336*b* may be configured to extend out of the cavity 1302 through a slot formed in the lower shell 1112 for connection to the first electrical connector provided in the receptacle of the control box.

A magnet 1328 (i.e., a second magnet) may be provided on the inner wall 1308 of the lower shell 1112 of the device body 1108. The second magnet 1328 may be positioned on the lower shell 1112 so that it aligns with and magnetically connects to the first magnet provided in the control box to secure the remote control device 1102 in the receptacle of the control box.

The massage component 1104 of the remote control device 1102 may include at least one of a cover 1326, a massage head 1322, a heating element 1320, a temperature sensor 1324, a massage head support 1318, a vibrating element 1316, and a support connector 1350. The massage head 1322, vibrating element 1316, heating element 1320, and temperature sensor 1324 may be coupled to the massage head support 1318, and the massage head support 1318 may be attached to the support connector 1350. The cover 1326 may be secured to the support connector 1350 to cover the massage head support 1318 and massage head 1322.

The massage component 1104 may be provided on an end of the device body 1108. The support connector 1350 of the massage component 1104 may include a support frame 1340 and a support disc 1314. A support slot 1342 may be formed in an end wall 1348 of the lower shell 1112 of the device body 1108, and the support connector 1350 may be positioned in the support slot 1342 so that the support disc 1314 is positioned against an outer surface of the end wall 1348 and the support frame 1340 is positioned against an inner surface of the end wall 1348.

The massage head support 1318 may connect to the support connector 1350 and the vibrating element 1316 may be positioned between the massage head support 1318 and the support connector 1350. Projections 1346 may be provided in an interior area of the massage head support 1318 for coupling to the support frame 1340 and for securing the vibrating element 1316 in place. In an aspect, the support frame 1340 may include one or more receivers 1344 that are sized and shaped to receive the projections 1346. The receiver 1344 may be configured so that wires housed in the cavity 1302 of the device body 1108 may pass through to connect to a contact provided in the massage head support 1318 to provide electrical connection between the support connector 1350, the massage head support 1318, and a power supply (e.g., battery 1330).

The massage head 1322 may be coupled to the massage head support 1318. The massage head 1322 may include a projection platform 1352 that may be received in a receptacle (not show) formed in the massage head support 1318. In an aspect, the massage head 1322 may be secured in place with an interference fit. A heating element 1320 and temperature sensor 1324 may be provided between the massage head 1322 and the massage head support 1318 and may be retained in the receptacle formed in the massage head support 1318. In an embodiment, a recess (not shown) may be formed in the projection platform 1352 to help facilitate a cover 1326 being coupled to the massage head support 1318. The massage component 1104 may be used with the cover 1326 in place on the massage head support 1318, i.e., by placing the cover 1326 on a location for treatment.

Figure 14:
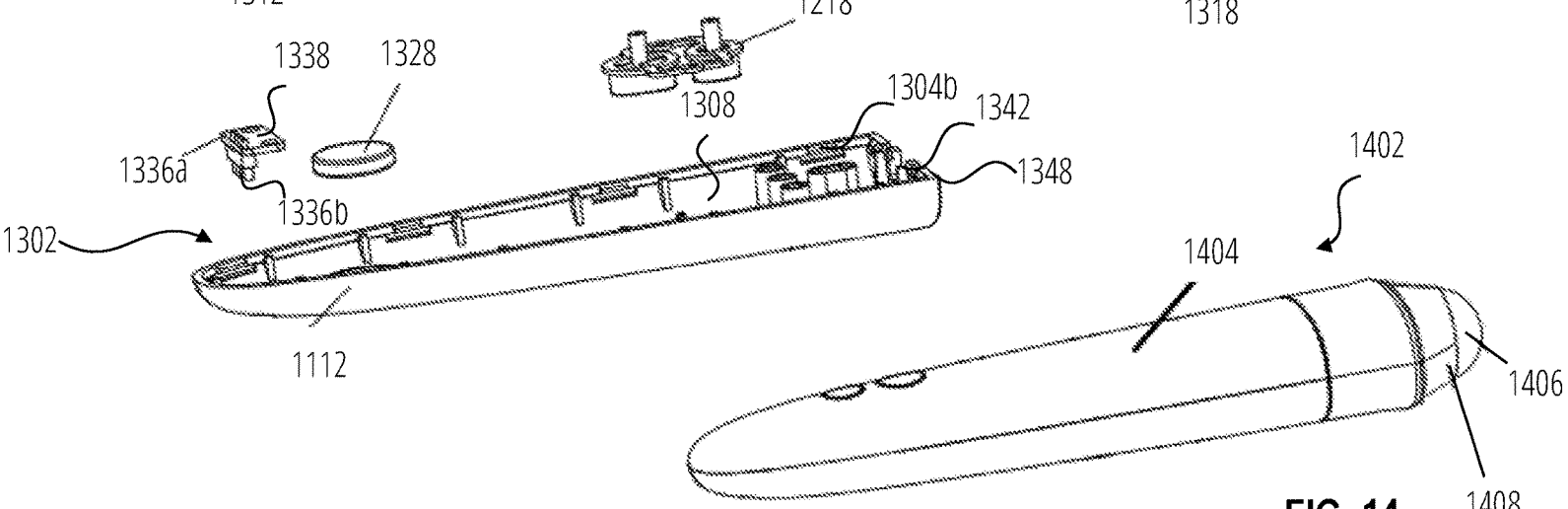
FIG. 14 is a perspective view of a remote control device, according to an embodiment.

FIG. 14 shows a remote control device 1402 with no cover. Similarly to the remote control device 1102 described above, the remote control device 1402 may include a device body 1404 and a massage head 1406 connected to the device body 1404 with a massage head support 1408. The remote control device 1402 may be used with no cover as shown in FIG. 14, i.e., by placing the massage head 1322 directly on the location for treatment.

Figure 15:
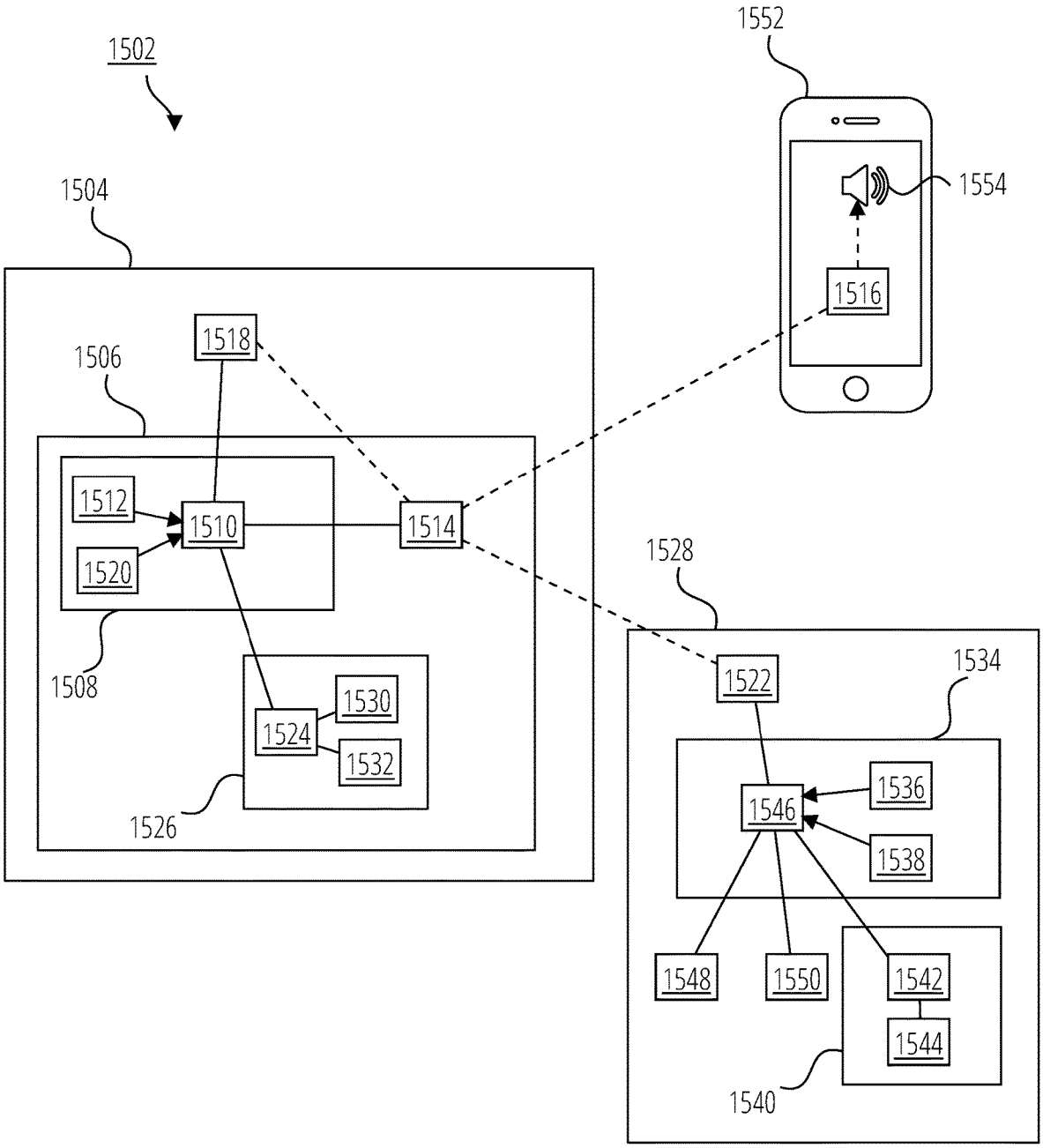
FIG. 15 is a circuit block diagram of a smart furniture controller, according to an embodiment.

FIG. 15 is a schematic diagram of a smart furniture assembly 1502. The smart furniture assembly 1502 may include a furniture item 1504, equipped with one or more functional units 1518, including for example and not limitation, a massage component, a seat adjuster, a heating component, and the like. The functional unit 1518 may be configured to adjust a physical parameter of the furniture item 1504 by initiating an actuator or motor associated with the functional unit.

A control box 1506 may be provided or installed on or in the furniture item 1504. The control box 1506 may include a first control circuit 1508 which may include one or more control buttons 1512, 1520, each associated with a first processor 1510. The first processor 1510 may be connected, through a wired connection or wirelessly, to the functional unit 1518 of the furniture item 1504. A user may press one or more of the control buttons 1512, 1520 to send a control signal to the processor 1510, which in turn controls the functional unit 1518 to adjust a physical parameter of the furniture item 1504.

The control box 1506 may include a first power supply circuit 1526 including a first power supply 1524, a first electrical connector 1530, and a first charging interface 1532. The first power supply 1524 may provide an electrical connection to an external power source, and may be electrically connected to at least one of the first electrical connector 1530, the first charging interface 1532, and the first processor 1510 and components of the control box 1506 for transmission of electrical power thereto. The first electrical connector 1530 may be configured to electrically connect to the remote control device when the remote control device is positioned in the receptacle of the control box, as described above. The first charging interface 1532 may include electrical power connections, for example, a USB connector or a USB type-C connector. The first charging interface 1532 may be configured to provide electrical power to an electrical accessory, such as a cellphone or a tablet.

The control box 1506 may include a first wireless communication assembly 1514, connected through a wired connection or wirelessly, to the first processor 1510. A user may press one or more control buttons 1512, 1520 to send a control signal through the first processor 1510 and the first wireless communication assembly 1514 to an external receiver. The external receiver may be, for example and not limitation, associated with the functional unit 1518 of the furniture item 1504, or with a remote control device 1528 or a portable household device (e.g., a phone 1552) as described below.

The smart furniture assembly 1502 may include a remote control device 1528. The control box 1506 may include a receptacle (as described hereinabove) configured to receive and retain the remote control device 1528. The remote control device 1528 may include a second control circuit 1534 and a second power supply circuit 1540. The second power supply circuit 1540 may include a second power supply 1542 and a second electrical connector 1544. The second electrical connector 1544 may connect to the first electrical connector 1530 as described above, and the second power supply 1542 may provide power to the second control circuit 1534. The second control circuit 1534 may include control buttons 1536, 1538 and a second processor 1546. The control buttons 1536, 1538 may be configured to send a control signal to the second processor 1546 to communicate with the control box 1506 or to control the functional unit 1518 of the furniture item 1504. The remote control device 1528 may include a second wireless communication assembly 1522 connected, through wired connection or wirelessly, to the second processor 1546. A user may push a control button 1536, 1538 to send the control signal to the second processor 1546, which may then send the control signal to the second wireless communication assembly 1522 to communicate the control wirelessly to the control box 1506 or furniture item 1504.

In an aspect, a user may wish to locate the remote control device 1528. The user may push a control button 1512, 1520 on the control box 1506 configured to send an alarm signal to the remote control device 1528. The alarm signal may be sent wirelessly from the first wireless communication assembly 1514 to the second wireless communication assembly 1522, which may prompt the second processor 1546 to initiate an alarm 1548 provided in the remote control device 1528. In an aspect, a household device, such as a phone 1552, may be equipped with a wireless receiver 1516 and the user may locate the phone 1552 using similar means. The user may push a control button 1512, 1520 on the control box 1506 configured to send an alarm signal to the phone 1552. The alarm signal may be sent wirelessly from the first wireless communication assembly 1514 to the phone 1552, which may be equipped with a wireless communication assembly that may initiate an alarm (e.g., integrated buzzer 1554) provided in the phone 1552.

In an aspect, the control buttons 1536, 1538 may be configured to initiate a massage component 1550 installed in the remote control device 1528. The user may push the control button 1536, 1538 to send a control signal to the second processor 1546 to adjust a parameter of the massage component 1550, including for example and not limitation, a heating element and a vibrating motor component.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A smart furniture controller, comprising:

a remote control device;

a control box comprising a receptacle configured to receive and retain the remote control device;

a first magnet provided within the receptacle, wherein the first magnet is provided on an inner wall of the control box;

a second magnet provided in the remote control device, wherein the first magnet and the second magnet are configured to magnetically connect when the remote control device is positioned in the receptacle; and at least one control button on the receptacle, wherein the at least one control button is only accessible when the remote control device is not positioned in the receptacle.

2. The smart furniture controller of claim 1, wherein the control box further comprises:

a first control circuit;

a first wireless communication assembly; and an external wireless receiver configured to receive a control signal from the first control circuit, wherein the wireless receiver comprises an integrated alarm, wherein the first control circuit is connected to the at least one control button, the at least one control button being configured to send a control signal through the first wireless communication assembly to the wireless receiver, and after receiving the control signal from the at least one control button, the wireless receiver is configured to initiate the integrated alarm.

3. The smart furniture controller of claim 1, further comprising:

a search button provided on the control box and connected to a first wireless communication assembly, wherein the search button is configured to send a search prompt signal to the remote control device through the first wireless communication assembly; and an alarm provided on the remote control device, wherein the remote control device is configured to initiate the alarm after receiving the search prompt signal.

4. The smart furniture controller of claim 2, wherein the control box further comprises:

an upper box body;

a lower box body; and a first power supply circuit, wherein the first power supply circuit comprises:

a charging interface provided in the lower box body, and a first electrical connector provided adjacent the receptacle in the lower box body, wherein the first electrical connector is connected to the first control circuit.

5. The smart furniture controller of claim 4, further comprising:

a second electrical connector provided on the remote control device, wherein the first electrical connector and the second electrical connector are electrically connected when the remote control device is positioned in the receptacle.

6. The smart furniture controller of claim 4, wherein:

the upper box body of the control box further comprises a plurality of upper side walls;

the lower box body of the control box further comprises a plurality of lower side walls; and the control box further comprises two or more elastic components provided on more than one of the upper side walls or more than one of the lower side walls, wherein the two or more elastic components are made of rubber, plastic, resin, or metal, a cross-section of the two or more elastic components is triangular or bowed, and at least a part of each surface of the two or more elastic components is flat, saw-toothed, or wavy.

7. The smart furniture controller of claim 6, wherein:

the control box is a three-dimensional structure comprising one of a rectangular shape, a cube shape, a cylindrical shape, an elliptic shape, a pocket shape, a pistol shape, and an axe shape; and the relative position of the upper box body to the lower box body is one of the upper box body being superimposed above the lower box body, the upper box body being superimposed below the lower box body, the upper box body being nested within the lower box body, or the lower box body being nested within the upper box body.

8. The smart furniture controller of claim 1, further comprising:

a removal access portion provided at a position adjacent to the receptacle.

9. The smart furniture controller of claim 1, wherein the control box is installed in a furniture item.

10. A smart furniture assembly, comprising:

a furniture item including a functional unit configured to initiate one or more of a position adjustment function, a massage function, and a heat function of the furniture item;

a control box provided on the furniture item, the control box comprising:

a receptacle configured to receive and retain a remote control device, a first control circuit including a first control button configured to control the functional unit of the furniture item, and a first wireless communication assembly; and a remote control device, the remote control device comprising:

a massage component including a vibrating element provided on the remote control device, a second control circuit including a second control button configured to control at least one of the functional unit of the furniture item and the massage component, and a second wireless communication assembly, wherein the first wireless communication assembly is configured to send a control signal to the remote control device and the second wireless communication assembly is configured to send a control signal to the control box.

11. The smart furniture assembly of claim 10, further comprising:

an alarm connected to the second control circuit, wherein the second wireless communication assembly is configured to receive a control signal from the control box to initiate the alarm upon receipt of the control signal.

12. A remote control device, comprising:

a device body sized and shaped to be positioned in a receptacle provided in a smart furniture item;

a power supply circuit;

a control circuit;

a wireless communication assembly;

a massage component coupled to the device body, wherein the massage component is electrically connected to the control circuit;

a first control button connected to the control circuit and configured to send a control signal to control a functional unit of the furniture item through the wireless communication assembly; and a second control button connected to the control circuit and configured to send a control signal to control the massage component.

13. The remote control device of claim 12, wherein:

the device body further comprises an upper shell and a lower shell coupled together to form a cavity;

the first control button is provided on the upper shell; and the second control button is provided on the lower shell.

14. The remote control device of claim 12, wherein the massage component further comprises:

a support connector positioned between and connecting the device body and the massage component;

a massage head support connected to the support connector;

a vibrating element;

a massage head;

a heating element;

a temperature sensor; and a top cover, wherein the vibrating element, the massage head, the heating element, and the temperature sensor are configured to couple to the massage head support; and the top cover is configured to couple to the support connector to cover the massage component.

15. The remote control device of claim 12, wherein:

the power supply circuit comprises at least one of a power supply and a charging module;

the power supply comprises one of a lithium battery, an alkaline battery, a nickel cadmium battery, and a nickel hydrogen battery; and the charging module comprises one of a USB charging module, a type-C charging module and an electromagnetic induction charging module.

16. The remote control device of claim 14, wherein:

the massage head further comprises at least one massage head made from stone, jade, salt, precious metal, or silica gel;

the heating element further comprises a heating plate including a semiconductor; and the vibrating element comprises a vibration motor.

17. The remote control device of claim 12, further comprising:

an electrical connector provided on the device body, wherein the remote control device is configured to connect to a second electrical connector provided on the receptacle in the furniture item when the remote control device is positioned in the receptacle.

18. The remote control device of claim 12, further comprising:

a first magnet provided in the device body, wherein the remote control device is configured to magnetically couple with a second magnet provided in the receptacle in the furniture item when the remote control device is positioned in the receptacle.

19. The remote control device of claim 12, further comprising:

an alarm connected to the control circuit, wherein the wireless communication assembly is configured to receive a control signal from the furniture item to initiate the alarm upon receipt of the control signal.

* * * * *